US007181815B2

(12) United States Patent
Hunter

(10) Patent No.: US 7,181,815 B2
(45) Date of Patent: Feb. 27, 2007

(54) GRAVE SITE COVER

(76) Inventor: Stanfield L. Hunter, P.O. Box 1518, Abilene, TX (US) 79604

( * ) Notice: Subject to any disclaimer, the term of this patent is extended or adjusted under 35 U.S.C. 154(b) by 101 days.

(21) Appl. No.: 10/760,162

(22) Filed: Jan. 20, 2004

(65) Prior Publication Data

US 2005/0155197 A1 Jul. 21, 2005

(51) Int. Cl.
*E02D 19/00* (2006.01)

(52) U.S. Cl. ..... 27/30

(58) Field of Classification Search ..... D99/20–21
See application file for complete search history.

(56) References Cited

U.S. PATENT DOCUMENTS 728,081 A * 5/1903 Buchanan ..... 52/103
873,279 A * 12/1907 Weber-illig ..... 47/41.01
1,053,872 A * 2/1913 Rankin et al. ..... 27/30
1,431,154 A * 10/1922 Dilger ..... 52/38
1,683,654 A * 9/1928 Buel ..... 27/30
1,730,289 A * 10/1929 Parker ..... 52/128
1,882,986 A * 10/1932 Schroeder ..... 27/30
1,886,437 A * 11/1932 Wartman ..... 27/30
1,916,941 A * 7/1933 Williams ..... 27/30
2,015,889 A * 10/1935 Fineman ..... 27/30
2,147,858 A * 2/1939 Parker ..... 27/30
3,157,557 A * 11/1964 Palmer ..... 428/17
5,437,127 A * 8/1995 Ha ..... 52/103

* cited by examiner

*Primary Examiner*—William L. Miller

(57) ABSTRACT

A grave site cover is disclosed comprising a snap-together heavy plastic tube frame, fittings and couplings, an artificial turf cover, transparent identification insert and anchor stakes. The artificial turf cover is rolled over and along the outside frame edge and attached with self-tapping stainless steel flange head screws. Three- and four-way fittings are provided at all four corners for inserting the ground anchor takes, additional fittings are provided at the center point and head marker for inserting ground anchor stakes, used for securely holding the grave site cover in place. The artificial turf grave cover may be fabricated in a variety of colors, with images, text, art or other décor. Said grave site cover can be hand assembled and easily installed, is weather resistant, durable and economical to manufacture, thereby providing a neat, dignified, maintenance-free and durable grave site cover.

3 Claims, 3 Drawing Sheets

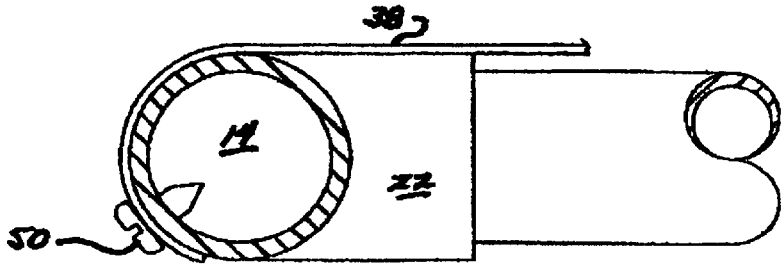
FIG 5
FIG 6
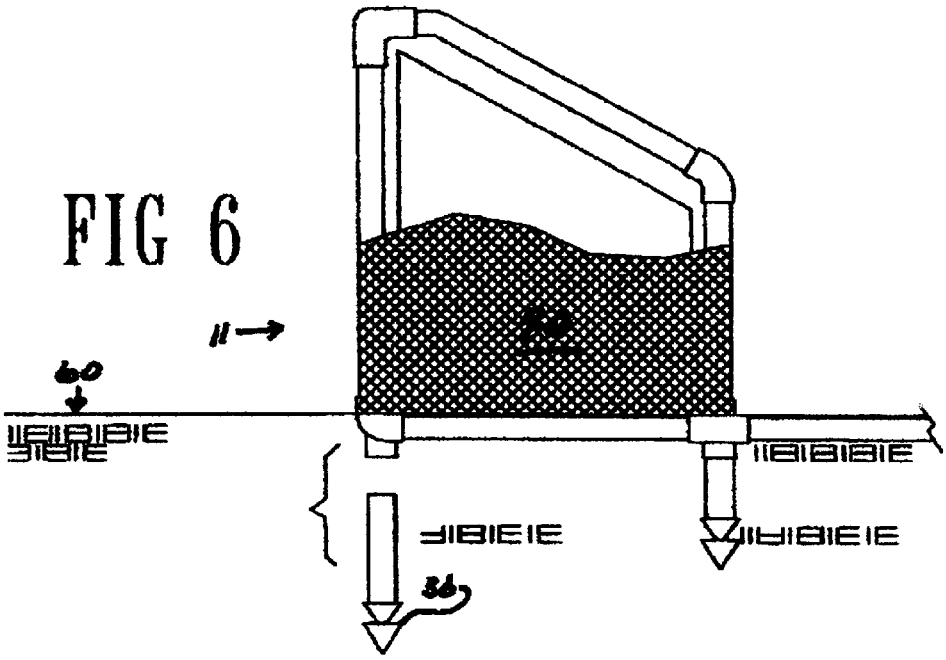

GRAVE SITE COVER

BACKGROUND OF THE INVENTION

This invention relates to covers for grave sites.

Grave sites require considerable maintenance in order to be kept in an attractive and dignified state. Usually they are planted with flowers, sod or otherwise decorated to maintain their appearance. These services involve substantial labor, and hence considerable cost.

There exists a need for a high quality grave cover that is weather resistant, durable, inexpensive to manufacture, and easy to install.

OBJECTS OF THE INVENTION

Accordingly, it is an object of the present invention to provide a grave cover which reduces the need for and expense of maintaining grave sites.

It is a further object of the present invention to provide a grave cover which maintains the grave in an attractive and dignified state.

Another object of the present invention is to provide a grave cover manufactured from materials which are non-corrosive and weather resistant.

It is still a further object of this invention to provide a grave cover which is firmly and securely anchored into the ground.

It is therefore an object of the present invention to provide a grave cover.

Another object of the present invention is to provide a headstone cover.

Yet another object of the present invention is to provide a headstone cover frame.

A still further object of the present invention is to provide ground stakes for attaching the grave cover frame securely in the ground.

And another object of the present invention is to provide ground stakes for attaching the headstone cover frame securely in the ground.

And yet another object of the present invention is to provide a weather resistant grave cover.

It is still another object of the present invention to provide a grave cover of various sizes.

A further object of the present invention is to provide a headstone cover in various sizes.

A still further object of the present invention is to provide a grave cover in various colors.

And another object of the present invention is to provide a headstone cover in various colors.

Yet another object of the present invention is o provide a grave cover for pets and animals.

It is a further object of the present invention to provide a headstone over for pets and animals.

Another object of the present invention is to provide a snap-together grave cover frame.

A further object of the present invention is to provide a grave cover and frames that requires minimum hand tools for installation.

Yet another object of the present invention is to provide a headstone frame and cover that requires minimum hand tools for installation.

A still further object of the present invention is to provide a grave cover with various designs on the surface such as angels, scenic landscapes, scripture or pictures.

Other objects and advantages of the present invention will become apparent by reading the detailed description of the invention in conjunction with the accompanying drawings.

BRIEF DESCRIPTION OF THE DRAWINGS

FIG. 5 is a partial sectional view of the grave cover frame, grave cover and cover attachment.

FIG. 6 is a cutaway partial elevation side view of a grave cover frame, head marker frame and cover, attached ground stake and detached ground stake.

DETAILED DESCRIPTION OF THE PREFERRED EMBODIMENT

Those familiar in the art will readily see and understand the simplicity of the present invention, from the snap together Schedule 40 plastic tube frame to the artificial turf cover. The frame and all components are standard fittings, couplings and tube sizes. Therefore it is understood that a grave site cover could be modified to accommodate any size grave site, or expanded to cover several connecting grave sites, by simply adding longer or shorter lengths of pipe and the necessary fittings and couplings. The grave site turf cover itself is manufactured in single standard sizes familiar in the industry; however, it could be custom fabricated easily to accommodate almost any need. For the purpose of identifying the different parts of the present invention, please refer to the "Component List" page included in this application.

Figures 1, 2:
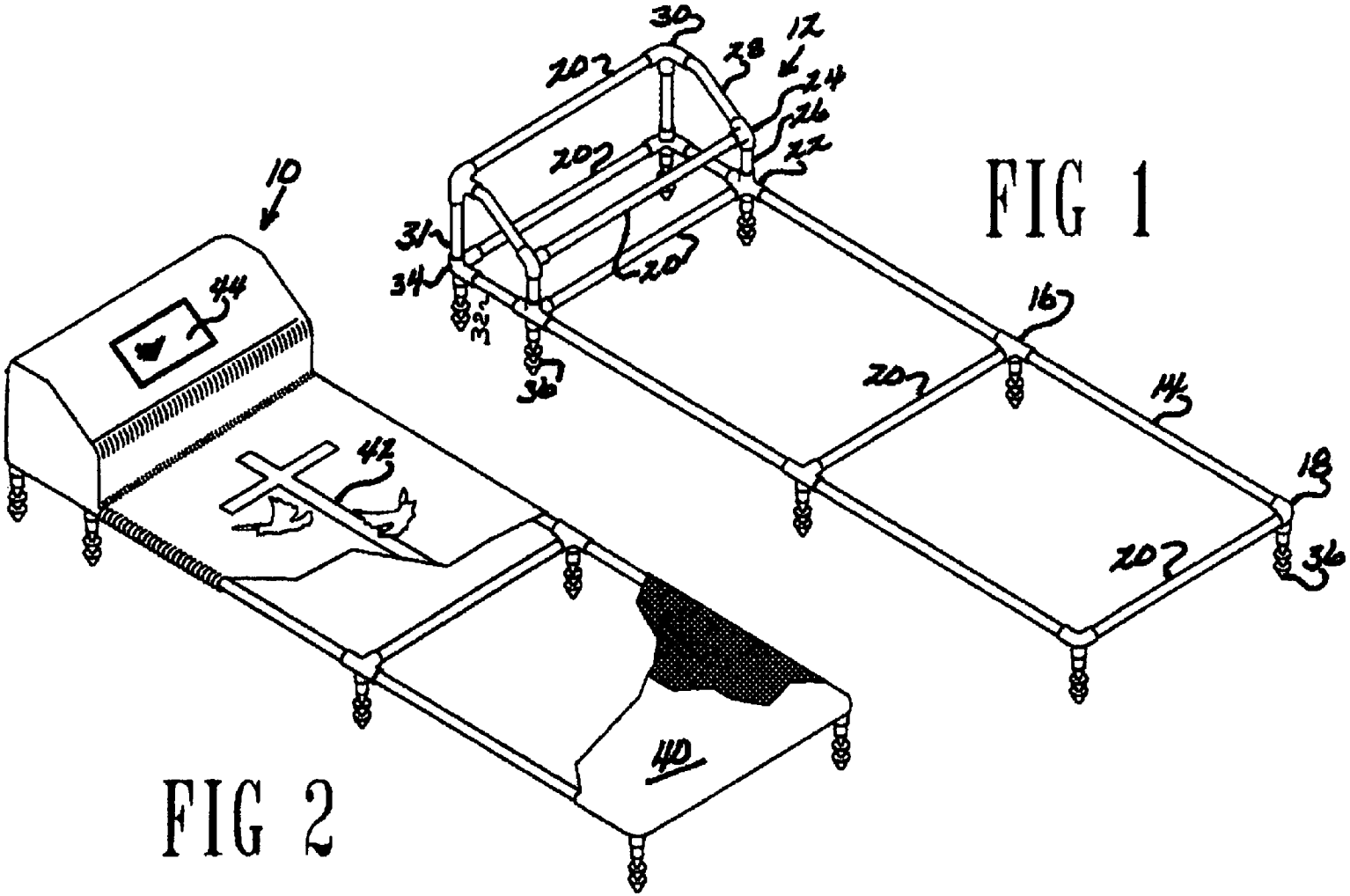
FIG. 1 illustrates a plain view of a framework for a grave cover showing the ground stakes and raised head marker.
FIG. 2 is a perspective cutaway view of a grave cover showing a framework, raised head marker and custom designed grave cover. The design on the grave cover is for illustration purpose only and not intended as any part of the present application.
Figure 3:
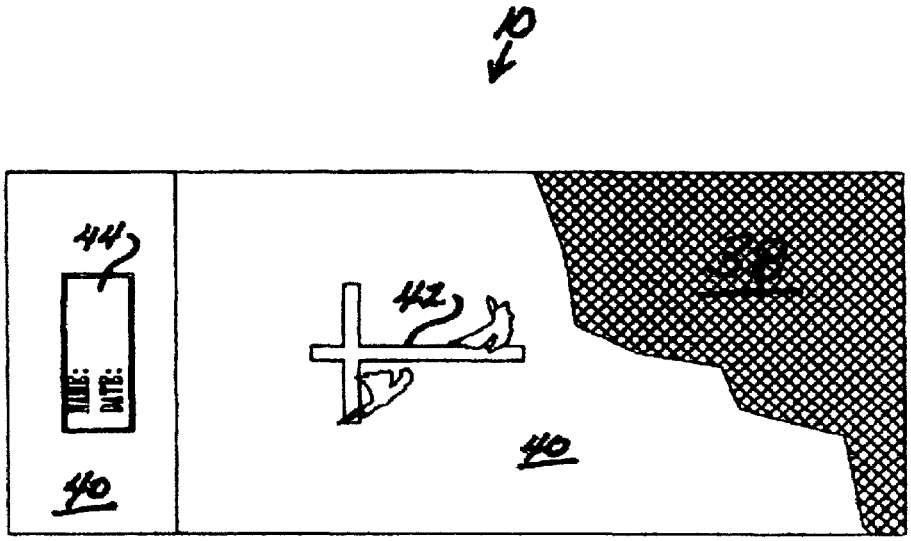
FIG. 3 is a plan top cutaway view illustrating a plan grave cover, a custom designed grave cover and raised head marker. As stated above, the custom design on the grave covers for illustration purpose only and not intended as any part of the present application.

Referring to the drawings, FIG. 1 and FIG. 2 illustrate a Schedule 40 plastic tube frame 12 and grave site cover 10 in accordance with the present invention, which is designed to fit over a grave site. The custom design 42 of FIG. 2 and FIG. 3 is for illustration only and is not claimed as part of the present invention. For the purpose of clarity and explanation, the following description and explanation of a grave site frame and cover will be for an adult space in a cemetery, approximately three feet by seven feet. Drawing FIG. 1: In order to build and assemble a grave site frame as illustrated, the following components would be used:

Schedule 40 plastic tubing:

(4) Sticks of Schedule 40 plastic tubing approximately 34 inches long shown at 14;

(2) Sticks of Schedule 40 plastic tubing approximately 10 inches long shown at 32;

(6) Sticks of Schedule 40 plastic tubing approximately 35 inches long shown at 20;

(2) Sticks of Schedule 40 plastic tubing approximately 11 inches long shown at 28;

(2) Sticks of Schedule 40 plastic tubing approximately 8 inches long shown at 31;

(2) Sticks of Schedule 40 plastic tubing approximately 3 inches long at 26.

Schedule 40 plastic fittings and couplings:

(2) 4-way fittings shown at 16;

(2) Corner T fittings shown at 18;

(2) 5-way fittings shown at 22, (2) 4-way corner fittings shown at 34;

(2) 22° T fittings shown at 24;

(2) Corner T fittings shown at 30;

(8) Ground stakes shown at 36.

Assembling the Grave Site Cover Frame

First: Lay out the pieces as shown in FIG. 1.

Second: Working from one side:

Insert stick 20 ends into side of 3-way corner fitting 18;

Insert stick 14 ends into side of 3-way corner fitting 18;

Insert opposite ends of stick 14 into side of 4-way fitting 16;

Insert stick 20 ends into side of 4-way fitting 16;

Insert stick 14 end into side of 4-way fitting 16;

Insert opposite end of stick 14 into side of 5-way fitting 22;

Insert stick 20 end into side of 5-way fitting 22;

Insert stick 32 ends into side of 5-way fitting 22;

Insert opposite end of stick 32 into side of 4-way corner fitting 34;

Insert stick 20 ends into side of 4-way corner fitting 34;

Insert stick 26 end into 5-way fitting 22;

Insert opposite ends of stick 26 into 22° T fitting 24;

Insert stick 20 ends into side of 22° T fitting 24;

Insert stick 28 ends into 22° T fitting 24;

Insert opposite ends of stick 28 into 3-way corner fitting 30;

Insert stick 31 ends into 4-way corner fitting 34;

Insert opposite ends of stick 31 into 3-way corner fitting 30;

Insert stick 20 ends into side of 3-way corner fitting 30;

Insert ground stakes 36 into underside 18, 16, 22 and 34.

Figure 4:
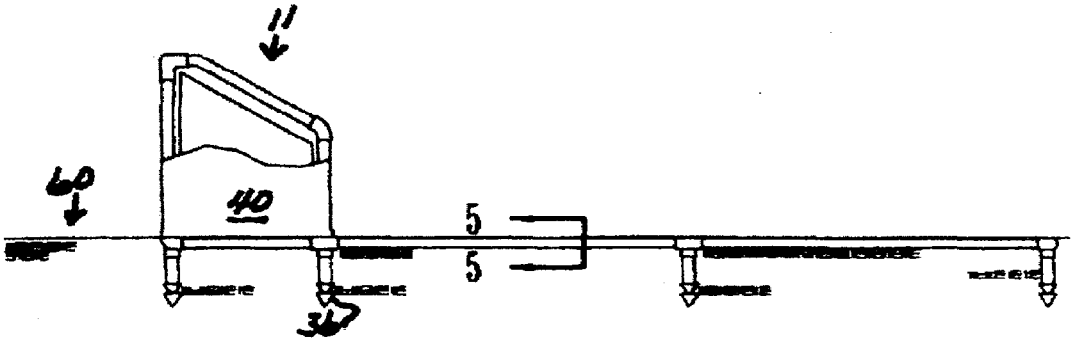
FIG. 4 is a cutaway side elevation view of a grave cover showing a raised head marker frame and cover and grave cover frame with ground stakes.

Drawings FIG. 2 and FIG. 3 are an illustration of the versatility and a sample custom design of what can be done with grave cover 10. The grave frame 12 may be covered with artificial turf 38 of almost any color. Or, the cover may be custom designed 42 with any picture, symbol or text. The cross and doves 42 are for illustration purposes only. The grave cover 38 of FIG. 2 and FIG. 3 is pre-cut from a pattern and fabricated together; a transparent identification insert 44 is fabricated into the head marker 40. A grave site cover 38 is fitted over a grave site frame 12. FIG. 5 is a partial cut-away view showing the grave cover 38 and method of attaching the grave cover 38 to grave frame 12 with self-tapping flange head stainless steel screws 50. FIG. 4 is a cut-away view of the head marker 11 and grave cover 38, and a side elevation view of a grave site cover 10. FIG. 6 is a cut-away view of a head marker 11 and custom designed cover 40 and the ground stakes 36 and ground stake fitting 34.

Various changed and modifications may be made to the grave site cover without departing from the spirit or scope of the invention, and the above description is meant to be illustrative only.

COMPONENT LIST

10 . . . Grave site cover
12 . . . Grave site cover frame
11 . . . Head marker
14 . . . Schedule 40 tubing
16 . . . 4-way fitting
18 . . . 3-way corner fitting
20 . . . Schedule 40 tubing
22 . . . 5-way fitting
24 . . . 3-way 22° fitting
26 . . . Schedule 40 tubing
28 . . . Schedule 40 tubing
30 . . . 3-way corner fitting
31 . . . Schedule 40 tubing
32 . . . Schedule 40 tubing
34 . . . 4-way corner tubing
36 . . . Ground Cover
38 . . . Artificial turf cover
40 . . . Head marker cover
42 . . . Illustrated design cover
44 . . . Transparent identification insert
50 . . . Self-tapping flange head stainless steel screws
60 . . . Ground surface

What is claimed is:

1. A grave site cover for placement over a grave site, said grave site cover comprising:

a plurality of plastic tubes;

a plurality of plastic joint fittings;

said tubes being joined by said fittings to define a grave cover frame and a head marker frame, said head marker frame being joined to said grave cover frame such that said head marker frame is raised relative to said grave cover frame;

an artificial turf covering including a portion defining a head marker cover having a transparent identification insert on a surface thereof;

means for attaching said artificial turf covering to said grave cover frame and said head marker frame to cover said grave cover frame and said head marker frame, said head marker cover enclosing said head marker frame; and a plurality of anchor stakes for securing said grave site cover to the ground and over the grave site.

2. A grave site cover as defined in claim 1, wherein said means for attaching comprises self-tapping stainless steel screws.

3. A grave site cover as defined in claim 1, wherein said anchor stakes are attached to an underside of said grave cover frame at the corresponding joint fittings.

* * * * *